US010737492B2

(12) United States Patent
Sugawara et al.

(10) Patent No.: US 10,737,492 B2
(45) Date of Patent: Aug. 11, 2020

(54) LIQUID EJECTING HEAD AND LIQUID EJECTING APPARATUS

(71) Applicant: SEIKO EPSON CORPORATION, Tokyo (JP)

(72) Inventors: Yoshiki Sugawara, Shiojiri (JP); Takeshi Yasoshima, Matsumoto (JP); Miyuki Muramoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/356,389

(22) Filed: Mar. 18, 2019

(65) Prior Publication Data

US 2019/0291431 A1 Sep. 26, 2019

(30) Foreign Application Priority Data

Mar. 20, 2018 (JP) ..... 2018-052134

(51) Int. Cl.
*B41J 2/14* (2006.01)

(52) U.S. Cl.
CPC ..... *B41J 2/14233* (2013.01); *B41J 2/14274* (2013.01)

(58) Field of Classification Search
CPC ..... B41J 2/14233; B41J 2/14274; B41J 2/04548; B41J 2/04581; B41J 2/14072; B41J 2/17526; B41J 2/1753; B41J 2/17546; B41J 2/14201
See application file for complete search history.

(56) References Cited

U.S. PATENT DOCUMENTS

| | | | | |
|---|---|---|---|---|
| 2006/0290747 | A1 | 12/2006 | Shimada et al. | |
| 2008/0239017 | A1* | 10/2008 | Takabe et al. | 347/68 |
| 2009/0244214 | A1 | 10/2009 | Fujita | |
| 2012/0229573 | A1 | 9/2012 | Mizukami et al. | |
| 2012/0236083 | A1* | 9/2012 | Mizukami et al. | 347/70 |
| 2014/0176646 | A1 | 6/2014 | Hirai et al. | |
| 2014/0253641 | A1* | 9/2014 | Furuya | B41J 2/14201 |
| 2014/0267504 | A1* | 9/2014 | Ohashi et al. | B41J 2/14201 |
| 2014/0267510 | A1 | 9/2014 | Furuya | |
| 2019/0036006 | A1 | 1/2019 | Sugawara et al. | |

FOREIGN PATENT DOCUMENTS

| | | |
|---|---|---|
| EP | 1671794 | 6/2006 |
| JP | 2005-119199 A | 5/2005 |
| JP | 2019-025704 A | 2/2019 |

OTHER PUBLICATIONS

European Search Report for EP 19164155 dated Aug. 6, 2019.

* cited by examiner

*Primary Examiner* — Juanita D Jackson
(74) *Attorney, Agent, or Firm* — Workman Nydegger

(57) ABSTRACT

A liquid ejecting head includes a piezoelectric element which includes a piezoelectric layer, and a first electrode and a second electrode sandwiching the piezoelectric layer therebetween, a leading-out wiring provided on an upper portion of the piezoelectric element and including a wiring layer made of gold or platinum and an underlayer which are patterned, and an insulating protective film which covers at least an exposed portion on the underlayer of the leading-out wiring.

18 Claims, 15 Drawing Sheets

LIQUID EJECTING HEAD AND LIQUID EJECTING APPARATUS

BACKGROUND

1. Technical Field

The present invention relates to a liquid ejecting head for ejecting a liquid from a nozzle and a liquid ejecting apparatus, and particularly to an ink jet type recording head for discharging ink as a liquid and an ink jet type recording apparatus.

2. Related Art

As an ink jet type recording head which is a typical example of a liquid ejecting head, there is an ink jet type recording head which includes a flow path forming substrate provided with a pressure generation chamber communicating with a nozzle, and a piezoelectric actuator provided on a surface side of the flow path forming substrate with a vibration plate interposed therebetween and having a first electrode, a piezoelectric layer, and a second electrode, and discharges ink droplets from the nozzle by generating pressure change in the pressure generation chamber by displacement of the piezoelectric actuator.

Such a piezoelectric actuator has a disadvantage that it tends to be broken due to an external environment such as moisture and the like; therefore, a structure in which the piezoelectric actuator is covered with a protective substrate and covered with a protective film such as aluminum oxide has been adopted in the related art (refer to, for example, JP-A-2005-119199).

However, with increasing integration density in recent years, a wiring led out from a piezoelectric actuator to a driving circuit or an electrical substrate is fine; therefore, under a severe condition, a problem occurs on an electrical connection. In particular, when ink containing a solvent is used, there is a possibility that a problem occurs on an electrical connection.

Such a problem is not limited to a liquid ejecting head typified by an ink jet type recording head but occurs in other piezoelectric devices as well.

SUMMARY

An advantage of some aspects of the invention is to provide a liquid ejecting head and a liquid ejecting apparatus that can avoid a problem, which occurs on an electrical connection, even under a severe condition.

According to an aspect of the invention, a liquid ejecting head includes a piezoelectric element which includes a piezoelectric layer, and a first electrode and a second electrode sandwiching the piezoelectric layer therebetween, a leading-out wiring provided on an upper portion of the piezoelectric element and including a wiring layer made of gold or platinum and an underlayer which are patterned, and an insulating protective layer which covers at least an exposed portion on the underlayer of the leading-out wiring.

In this case, since the insulating protective layer covering the exposed portion on the underlayer of the leading-out wiring is provided, ink resistance and migration resistance are improved. Therefore, even under a severe environment, corrosion does not occur and an occurrence of electrical malfunction is prevented, thereby improving reliability.

It is preferable that the underlayer be made of a material selected from chromium, nickel, a nickel chromium alloy, aluminum, and copper. According to this, it is possible to suppress the stress concentration when the piezoelectric actuator is displaced and to suppress the breakage.

It is preferable that the liquid ejecting head further include a recessed portion exposing the underlayer of the wiring layer, and the insulating protective layer also be provided in the recessed portion. According to this, since the insulating protective layer is also provided in the recessed portion, the adhesion between the wiring layer and the insulating protective layer is improved.

It is preferable that the liquid ejecting head further include a second insulating protective layer on a lower side of the underlayer. According to this, moisture-resistance protectiveness of the piezoelectric layer is secured by the second insulating protective layer, thereby further improving reliability.

It is preferable that the insulating protective layer and the second insulating protective layer be made of the same material. According to this, a preferable adhesion between the insulating protective layer and the second insulating protective layer, and excellent moisture resistance and ink resistance are achieved, thereby improving reliability.

It is preferable that the insulating protective layer be thicker than the second insulating protective layer. According to this, the ink resistance and the migration resistance are more reliably improved.

It is preferable that the piezoelectric element be provided on a flow path substrate provided with a pressure chamber communicating with a nozzle opening that discharges a liquid, the flow path substrate be bonded with a protective substrate having a piezoelectric element holding portion that is a space for holding the piezoelectric element, a dummy wiring be provided in a region where the leading-out wiring is not provided in a bonding area of the flow path substrate with which the protective substrate is bonded, and the insulating protective layer be provided on the dummy wiring. According to this, the height adjustment at the time of substrate bonding is facilitated, and the bonding property is also improved.

It is preferable that the insulating protective layer not be provided in a region facing the pressure chamber. According to this, there is no influence on driving of the piezoelectric element, and an irregular driving can be reduced.

It is preferable that the liquid be a solvent ink or a water-based ink. According to this, resistance to the solvent ink or the water-based ink can be improved by the insulating protective layer.

According to another aspect of the invention, a liquid ejecting apparatus includes the liquid ejecting head according to the aspect described above.

In this case, since the insulating protective layer covering the exposed portion on the underlayer of the leading-out wiring is provided, ink resistance and migration resistance are improved. Therefore, even under a severe environment, corrosion does not occur and an occurrence of electrical malfunction is prevented to realize a liquid ejecting apparatus with improved reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
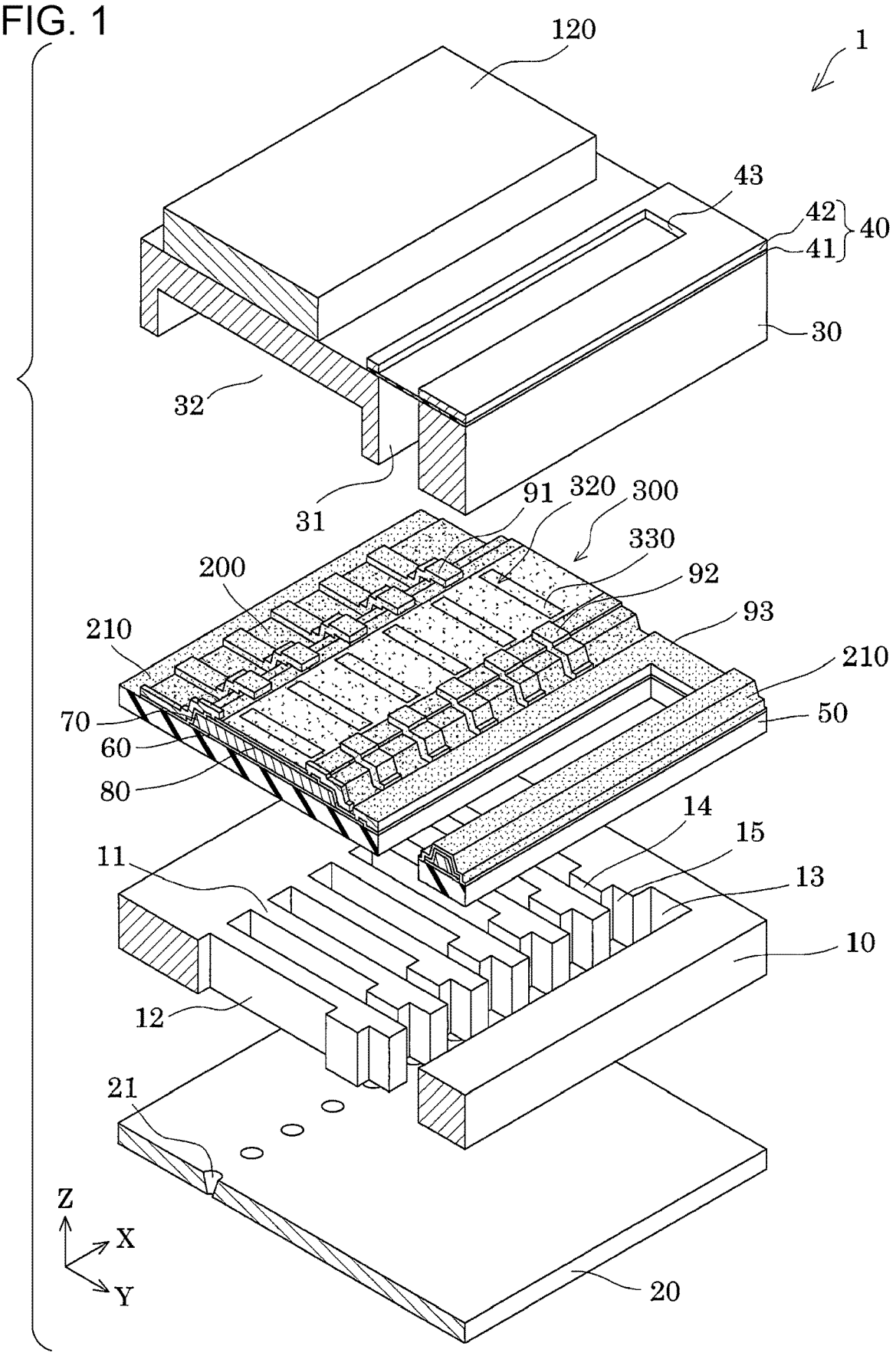
FIG. 1 is an exploded perspective view illustrating a recording head according to Embodiment 1 of the invention.
Figure 2:
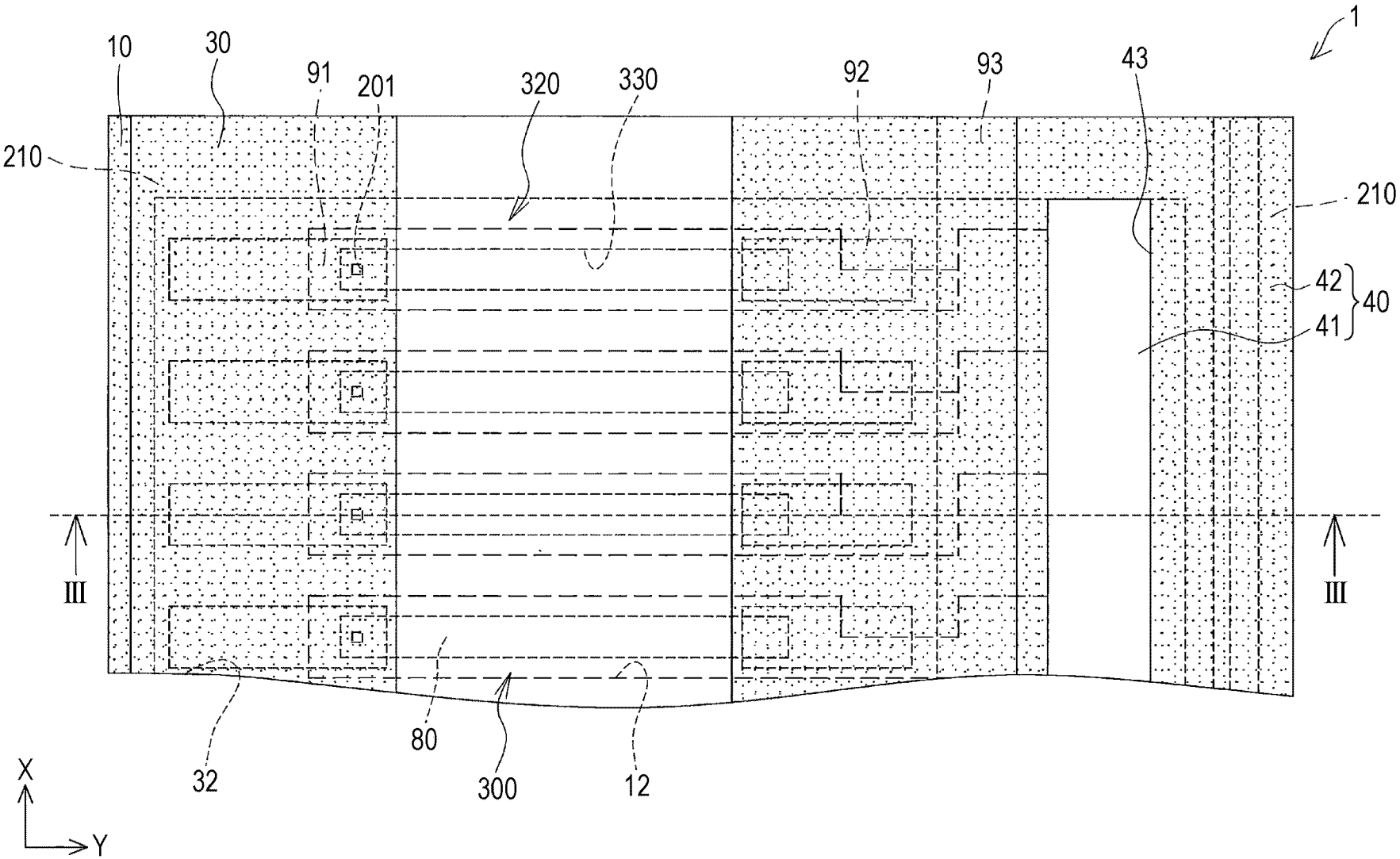
FIG. 2 is a plan view illustrating the recording head according to Embodiment 1 of the invention.
Figure 3:
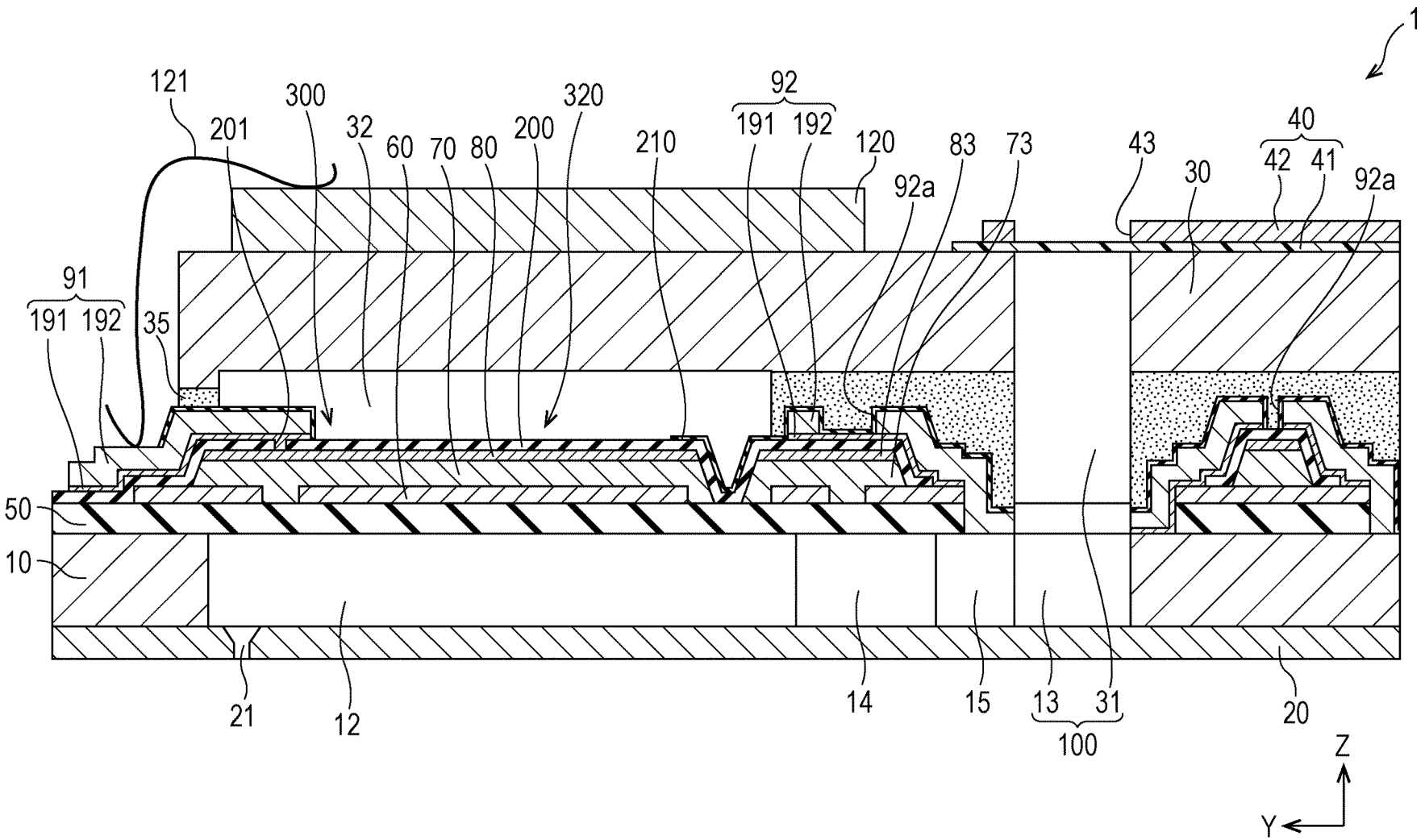
FIG. 3 is a sectional view illustrating the recording head according to Embodiment 1 of the invention.

FIG. 1 is an exploded perspective view illustrating a schematic configuration of an ink jet type recording head which is an example of a liquid ejecting head according to Embodiment 1 of the invention, FIG. 2 is a plan view of the ink jet type recording head, and FIG. 3 is a cross-sectional view taken along line III-III of FIG. 2.

As illustrated in FIGS. 1 to 3, a flow path forming substrate 10, as a substrate of the embodiment constituting an ink jet type recording head 1 (hereinafter, also simply referred to as recording head 1), is made of a metal such as stainless steel or Ni, a ceramic material typified by $ZrO_2$ or $Al_2O_3$, a glass ceramic material, an oxide such as MgO, $LaAlO_3$, or the like can be used. In the embodiment, the flow path forming substrate 10 is made of a silicon single crystal substrate.

The flow path forming substrate 10 is subjected to anisotropic etching from one surface side so that a plurality of nozzles 21 through which ink is discharged by a pressure generation chambers 12 which is a recessed portion of the embodiment, defined by a plurality of partition walls 11 and are arranged in parallel in a direction in which the plurality of partitions are arranged in parallel. In the embodiment, this direction is referred to as a parallel arrangement direction of the pressure generation chambers 12 or a first direction X. In addition, a direction orthogonal to the first direction X in the liquid ejecting surface where a nozzle 21 opens is referred to as a second direction Y. Furthermore, a direction intersecting both the first direction X and the second direction Y is referred to as a third direction Z in the embodiment. In the embodiment, the relationship between the respective directions (X, Y, Z) is orthogonal, but a disposition relationship of each configuration is not necessarily limited to those orthogonal.

In addition, on the flow path forming substrate 10, an ink supply path 14 and a communication path 15 are defined by partition walls 11 on a side of one end portion in the second direction Y of the pressure generation chamber 12. In addition, at one end of the communication path 15, a communication portion 13 constituting a portion of the manifold 100, as is a common ink chamber (liquid chamber) of each pressure generation chamber 12, is formed. In other words, the flow path forming substrate 10 is provided with a liquid flow path including the pressure generation chamber 12, the communication portion 13, the ink supply path 14, and the communication path 15.

The ink supply path 14 communicates with a side of one end portion of the pressure generation chamber 12 in the second direction Y and has a smaller sectional region than the pressure generation chamber 12. For example, in the embodiment, the ink supply path 14 has a smaller width than a width of the pressure generation chamber 12 by narrowing a flow path on a side of the pressure generation chamber 12 between the manifold 100 and each pressure generation chamber 12 in the first direction X as a width direction. In this way, in the embodiment, the ink supply path 14 is formed by narrowing the width of the flow path from one side, but by narrowing the width of the flow path in the first direction X from both sides, the ink supply path may be formed. In addition, instead of narrowing the width of the flow path, the ink supply path may be formed by narrowing the flow path from the third direction Z as a stacked direction. Further, each of the communication paths 15 communicates with a side opposite to the pressure generation chamber 12 of the ink supply path 14 and has a sectional region larger than the width direction (first direction X) of the ink supply path 14. In the embodiment, the communication path 15 is formed with the same sectional region as the pressure generation chamber 12.

In other words, the flow path forming substrate 10 is provided with the pressure generation chamber 12, the ink supply path 14 having a smaller sectional region than the sectional region of the pressure generation chamber 12 in the first direction X, and a communication path 15 which communicates with the ink supply path 14 and has a sectional region larger than the sectional region of the ink supply path 14 in the first direction X are defined by a plurality of partition walls 11.

In addition, on a side of an opening surface of the flow path forming substrate 10, a nozzle plate 20 in which the nozzle 21 communicating with the vicinity of the end portion on a side opposite to the ink supply path 14 of each pressure generation chamber 12 is drilled is fixed by an adhesive, a heat welding film, or the like. As the nozzle plate 20, for example, a metal such as stainless steel (SUS), an organic material such as a polyimide resin, a glass ceramics, a silicon single crystal substrate, or the like can be used. By using the same silicon single crystal substrate as the flow path forming substrate 10 as the nozzle plate 20, the linear expansion coefficients of the nozzle plate 20 and the flow path forming substrate 10 are made equal to each other, and the occurrence of warpage due to heating and cooling, cracks, peeling, and the like due to heat can be suppressed.

On the other hand, a vibration plate 50 is formed on a side of the flow path forming substrate 10 opposite to the nozzle plate 20. As the vibration plate 50, for example, a single layer or a stacked layer of at least one kind of material selected from silicon oxide, zirconium oxide, silicon nitride, polysilicon, and titanium oxide can be used.

When the pressure generation chamber 12 and the like is formed by anisotropically etching the flow path forming substrate 10 from the surface with which the nozzle plate 20 is bonded, it is preferable that at least one side of the flow path forming substrate 10 of the vibration plate 50 use a material that functions as an etching stop layer. In other words, it is preferable that at least the side of the vibration plate 50 on the flow path forming substrate 10 be made of a material different in an etching selection ratio with respect to the flow path forming substrate 10. Thus, the pressure generation chambers 12 and the like can be formed with high precision by anisotropic etching.

In addition, a piezoelectric actuator 300 having a first electrode 60, a piezoelectric layer 70, and a second electrode 80 is provided on the vibration plate 50 of the flow path forming substrate 10. In the embodiment, the piezoelectric actuator 300 serves as a pressure generating means for causing a pressure change in the ink in the pressure generation chamber 12. Here, the piezoelectric actuator 300 is also referred to as a piezoelectric element and is referred to as a portion including the first electrode 60, the piezoelectric layer 70, and the second electrode 80. In addition, a portion where piezoelectric strain occurs in the piezoelectric layer 70 when a voltage is applied between the first electrode 60 and the second electrode 80 is referred to as an active portion 320. In the embodiment, an active portion 320 is formed for each pressure generation chamber 12, which will be described in detail later. In the embodiment, the first electrode 60 serves as a common electrode of the plurality of active portions 320, and the second electrode 80 serves as an individual electrode independent from each of the active portions 320. In addition, in the active portion 320, an end portion in the first direction X and an end portion in the second direction Y are defined by the second electrode 80.

The first electrode 60 is provided in the second direction Y until the first electrode 60 reaches the outside of the end portion of the pressure generation chamber 12. In addition, the first electrode 60 is provided continuously over a plurality of the active portions 320. Specifically, both end portion sides of the first electrode 60 in the second direction Y are provided continuously in the first direction X, and the central portion of the first electrode 60 in the second direction Y is provided only under the active portion 320, that is, the first electrode 60 is not provided between the active portions 320 adjacent to each other in the first direction X. In other words, in the first electrode 60 between the active portions 320 adjacent to each other in the first direction X, the center portion of the pressure generation chamber 12 in the second direction Y is removed by a groove portion 330 described below in detail.

The width of the first electrode 60 in the first direction X has a width narrower than the width of the pressure generation chamber 12. In other words, when viewed in a plan view from the third direction Z, the first electrode 60 is provided to overlap with the pressure generation chamber 12.

For example, as such a first electrode 60, it is necessary that the first electrode 60 is made of a material that does not oxidize when the piezoelectric layer 70 is formed and can maintain conductivity, and examples thereof include noble metals such as platinum (Pt) and iridium (Ir), or a conductive oxide typified by lanthanum nickel oxide (LNO) or the like.

The end portion of the piezoelectric layer 70 in the second direction Y is provided between the end portion of the first electrode 60 and the end portion of the second electrode 80. An end portion of the second electrode 80 in the second direction Y defines an end portion of the active portion 320 and is disposed inside the end portion of the first electrode 60.

As a material of such a piezoelectric layer 70, for example, a ferroelectric piezoelectric material such as lead zirconate titanate (PZT), a relaxor ferroelectric to which a metal such as niobium, nickel, magnesium, bismuth or yttrium is added a ferroelectric or the like is used.

The second electrode 80 defines the end portions of the active portion 320 in the first direction X and the second direction Y. The second electrode 80 is provided inside the end portion of the first electrode 60 in the first direction X and the second direction Y. Here, in the second direction Y, the fact that the end portion of the second electrode 80 is provided inside the end portion of the first electrode 60 means that the end portion of the second electrode 80 in the second direction Y is not provided at the same position as the end portion of the first electrode 60 but the end portion of the second electrode 80 is positioned inside the first electrode 60 than the end portion of the first electrode 60, that is, the center side of the first electrode 60. The same applies to the first direction X.

The piezoelectric actuator 300 having the first electrode 60, the piezoelectric layer 70, and the second electrode 80 has a groove portion 330 that opens between the active portions 320 adjacent to each other in the first direction X.

The groove portion 330 is provided between the active portions 320 adjacent to each other in the first direction X, penetrates the piezoelectric layer 70 and the first electrode 60 in the third direction Z, and has a depth reaching a portion of the thickness of the vibration plate 50 in the third direction Z. In other words, the groove portion 330 is formed without penetrating the vibration plate 50, and a portion of the vibration plate 50 on a side of the flow path forming substrate 10 is formed on a bottom surface of the groove portion 330.

Such a groove portion 330 is formed so that the end portion in the first direction X is inside the end portion of the pressure generation chamber 12. In other words, the groove portion 330 is formed at a position overlapping the partition wall 11 between the pressure generation chambers 12 adjacent to each other in the first direction X in a plan view from the third direction Z and has a width larger than that of the partition wall 11.

By providing the groove portion 330 in such a piezoelectric actuator 300, it is possible to reduce the film thickness of the region facing the pressure generation chamber 12, that is, the so-called arm portion, outside the active portion 320 of the vibration plate 50 in the first direction X, without changing the film thickness and material of the vibration plate 50 directly under the active portion 320. In other words, in the first direction X, the piezoelectric layer 70 is not provided on the arm portion outside the active portion 320, so that the rigidity of the arm portion can be reduced. Likewise, without providing the first electrode 60 on the arm portion outside the active portion 320 in the first direction X, the rigidity of the arm portion can be reduced. In addition, by removing a portion of the arm portion in the third direction Z, as a stacked direction of the vibration plate 50, the rigidity of the arm portion can be reduced. In particular, the first electrode 60 is a common electrode common to the plurality of active portions 320, but without providing the first electrode 60 made of a metal or metal oxide having high rigidity on the arm portion, the rigidity of the arm portion can be reduced. As illustrated above, by reducing the rigidity of the arm portion of the vibration plate 50, it is possible to improve the displacement characteristics of the piezoelectric actuator 300, that is, to obtain a large displacement amount with a low drive voltage.

The piezoelectric actuator 300 is covered with a protective film 200 which is a second insulating protective film. The protective film 200 is made of an insulating material having moisture resistance. As the protective film 200, an inorganic insulating material, an organic insulating material, or the like can be used. As the inorganic insulating material which can be used as the protective film 200, at least one type selected from silicon oxide ($SiO_x$), zirconium oxide ($ZrO_x$), tantalum oxide ($TaO_x$), aluminum oxide ($AlO_x$), and titanium oxide ($TiO_x$) is included. As the inorganic insulating material of the protective film 200, it is particularly preferable to use aluminum oxide ($AlO_x$) which is an inorganic amorphous material, for example, alumina ($Al_2O_3$).

In addition, as the organic insulating material which can be used as the protective film 200, for example, at least one type selected from an epoxy resin, a polyimide resin, a silicone resin and a fluorine resin include.

In the embodiment, the protective film 200 covers the entire piezoelectric actuator 300. In other words, the protective film 200 is provided over the inner surface of the groove portion 330 of the piezoelectric actuator 300. Incidentally, by providing the protective film 200 in the groove portion 330, it is possible to suppress the breakage of the piezoelectric layer 70 due to leakage of current between the first electrode 60 and the second electrode 80 exposed on the inner surface of the groove portion 330. In other words, the protective film 200 may cover at least the surface of the piezoelectric layer 70 provided with the first electrode 60 and the second electrode 80 close to each other. Therefore, the protective film 200 may not be provided in the main portion as a substantially central region of the upper surface of the second electrode 80 but may be provided with an opening portion which opens the main portion of the second electrode 80. By providing an opening portion in the protective film 200 described above, it is possible to suppress the inhibition of the displacement by the protective film 200 and to improve the displacement of the piezoelectric actuator 300.

In addition, by covering the piezoelectric actuator 300 with the protective film 200, breakage of the piezoelectric layer 70 due to current leakage between the first electrode 60 and the second electrode 80 can be suppressed. In addition, the protective film 200 can function as an interlayer insulating film which insulates the leading-out wirings led out from the first electrode 60 (to be described below) and the second electrode 80 (to be described below), and it is possible to suppress the short circuit between the electrodes.

On the protective film 200, lead electrodes which are the leading-out wirings led out from the first electrode 60 and the second electrode 80 of the piezoelectric actuator 300 are provided.

The lead electrode of the embodiment has an individual lead electrode 91, a dummy lead electrode 92, and a common lead electrode (not illustrated). Here, each of the individual lead electrode 91, the dummy lead electrode 92, and the common lead electrode includes an underlayer 191 to be an adhesion layer and a wiring layer 192 provided on the underlayer 191. The underlayer 191 is for improving adhesion with the lower layer, and examples of a material thereof include nickel (Ni), chromium (Cr), nickel chromium (NiCr), titanium (Ti), titanium tungsten (TiW) or the like. A single above-described material may be used as the underlayer 191, or a plurality of materials may be used as the underlayer 191 in a mixed manner, and furthermore, a laminate where a plurality of layers of different materials are stacked may be used as the underlayer 191. In the embodiment, nickel chromium (NiCr) is used as the underlayer 191. For example, gold (Au) or platinum (Pt) can be used for the wiring layer 192. In the embodiment, gold (Au) is used as the wiring layer 192.

The individual lead electrode 91 is connected to the end portion of the second electrode 80 on the side of the nozzle 21 in the second direction Y and extends in the second direction Y on the protective film 200 on the vibration plate 50, that is, extends to the outside of the end portion of the first electrode 60. Such an individual lead electrode 91 is electrically connected to the second electrode 80 through the first connection hole 201 provided in the protective film 200.

In the second direction Y, the dummy lead electrode 92 is disposed on the dummy piezoelectric layer 73 and the dummy second electrode 83, the dummy piezoelectric layers 73 and second electrodes 83 sandwiching the communication portion 13 and the manifold portion 31 therebetween, at an end portion of the second electrode 80 on the ink supply path 14 side. The dummy piezoelectric layer 73 and the dummy second electrode 83 are separated from the piezoelectric layer 70 and the second electrode 80 by a groove and the protective film 200 is continuously formed from the second electrode 80 to the dummy second electrode 83, and the dummy lead electrode 92 is provided on the protective film 200 provided on the dummy second electrode 83. The dummy lead electrodes 92 provided with the communication portion 13 and the manifold portion 31 interposed therebetween are, as described in detail later, continuously formed by a sealing portion 93 directly provided on the flow path forming substrate 10 until the communication portion 13 is formed by etching.

A recessed portion 92*a* that exposes the underlayer 191 is provided by removing the wiring layer 192 at a position facing the upper surfaces of the dummy piezoelectric layer 73 and the dummy second electrode 83 of the dummy lead electrode 92. The recessed portion 92*a* is for securing the adhesion with an insulating protective film 210 provided thereon which will be described later, and further for enhancing the adhesive strength with an adhesive 35.

In the embodiment, the insulating protective film 210 is provided to cover at least an exposed portion of the underlayer 191 of the leading-out wiring including such individual lead electrode 91, the dummy lead electrode 92, and the common lead electrode which is not illustrated. Here, the exposed portion of the underlayer 191 is a patterned end surface exposed by patterning the underlayer 191 and the wiring layer 192. Although such a patterned end surface is a significant fine area, it has been found that corrosion occurs due to moisture, ink, or the like, and cause electrical malfunction. Based on such knowledge, the insulating protective film 210 is provided to cover at least the patterned end surface of the underlayer 191.

As the insulating protective film 210, an inorganic insulating material similar to that of the protective film 200 can be used. An example of an inorganic insulating material that can be used as the insulating protective film 210 includes at least one selected from silicon oxide ($SiO_x$), zirconium oxide ($ZrO_x$), tantalum oxide ($TaO_x$), tantalum silicate ($TaSiO_x$), hafnium oxide ($HfO_x$), hafnium silicate ($HfSiO_x$), aluminum nitride ($AlN_x$), silicon nitride ($SiN_x$), aluminum oxide ($AlO_x$), and titanium oxide ($TiO_x$). Especially for the insulating protective film 210, aluminum oxide ($AlO_x$) which is an inorganic amorphous material, for example, alumina ($Al_2O_3$) is preferably used. This is because of the high protection capability and the high performance of uniformizing the heat distribution for each pressure generation chamber 12 due to the high thermal conductivity rate.

Here, the method of forming the insulating protective film 210 is not particularly limited and the insulating protective film 210 may be formed by chemical vapor deposition (CVD), atomic layer deposition (ALD), or the like, but it is preferable to form the insulating protective film 210 by low-temperature CVD in order to prevent the thermal diffusion of gold which is the wiring layer 192. The low-temperature CVD can prevent the thermal diffusion of the wiring layer 192 by forming the insulating protective film 210 at, for example, 130° C. to 140° C. It is also preferable to form insulating protective film 210 by ALD. It is possible to form a dense film with few pinholes at low temperature. As for the protective film 200, since the protective film 200 is not provided on the wiring layer 192, the protective film 200 may be formed by high-temperature CVD at 300° C. or higher.

Further, on the flow path forming substrate 10 on which the piezoelectric actuator 300 is formed, a protective substrate 30 having a manifold portion 31 provided in a region facing the communication portion 13 is bonded through an adhesive 35. As described above, the manifold portion 31 communicates with the communication portion 13 of the flow path forming substrate 10 to constitute a manifold 100 to be a common liquid chamber of each pressure generation chamber 12. In addition, the communication portion 13 of the flow path forming substrate 10 may be divided into a plurality of communication portions for each pressure generation chamber 12, and only the manifold portion 31 may be a manifold. Further, for example, the ink supply path 14 may be provided in which only the pressure generation chamber 12 is provided in the flow path forming substrate 10, and the member (for example, vibration plate 50) interposed between the flow path forming substrate 10 and the protective substrate 30 communicates a manifold with the pressure generation chambers 12.

In addition, the protective substrate 30 is provided with a piezoelectric element holding portion 32 which has a space that does not hinder the movement of the piezoelectric actuator 300 in a region facing the piezoelectric actuator 300. It is sufficient that the piezoelectric element holding portion 32 has a space that does not hinder the movement of the piezoelectric actuator 300, and the space may be sealed or not sealed.

In addition, a driving circuit 120 for driving the piezoelectric actuator 300 is mounted on the protective substrate 30. As the driving circuit 120, for example, a circuit substrate, a semiconductor integrated circuit (IC), or the like can be used. The driving circuit 120, and the individual lead electrode 91 and the common lead electrode are electrically connected to each other through a connecting wire 121 made of a conductive wire such as a bonding wire. The connection between the driving circuit 120, and the individual lead electrode 91 and the common lead electrode is not particularly limited, and COF may be used.

As the protective substrate 30, it is preferable to use a material having substantially the same thermal expansion coefficient as that of the flow path forming substrate 10, for example, glass, a ceramic material, an oxide, or the like, and in the embodiment, the silicon single crystal substrate same as the flow path forming substrate 10 was used.

In addition, on the protective substrate 30, a compliance substrate 40 including a sealing film 41 and a fixing plate 42 is bonded. Here, the sealing film 41 is made of a material having low rigidity and flexibility (for example, a polyphenylene sulfide (PPS) film having a thickness of 6 μm), and one surface of the manifold portion 31 is sealed by the sealing film 41. In addition, the fixing plate 42 is formed of a hard material such as metal (for example, stainless steel (SUS) having a thickness of 30 μm or the like). Since the region of the fixing plate 42 facing the manifold 100 is the opening portion 43 completely removed in the thickness direction, one surface of the manifold 100 is sealed only with the flexible sealing film 41.

In such an ink jet type recording head of the embodiment, ink is taken in from external ink supply means (not illustrated), and the interior thereof is filled with ink until the ink reaches from the manifold 100 to the nozzle 21, and then, according to the recording signal from the driving circuit 120, a voltage is applied between the first electrode 60 and the second electrode 80 corresponding to each pressure generation chamber 12 to deflect and deform the vibration plate 50, the first electrode 60, and the piezoelectric layer 70, whereby each pressure generation chamber 12 increases, and ink droplets are discharged from the nozzle 21.

Here, a manufacturing method of the recording head 1 of the embodiment, particularly a manufacturing method of the insulating protective film 210 will be described with reference to FIGS. 4 to 10.

Figure 4:
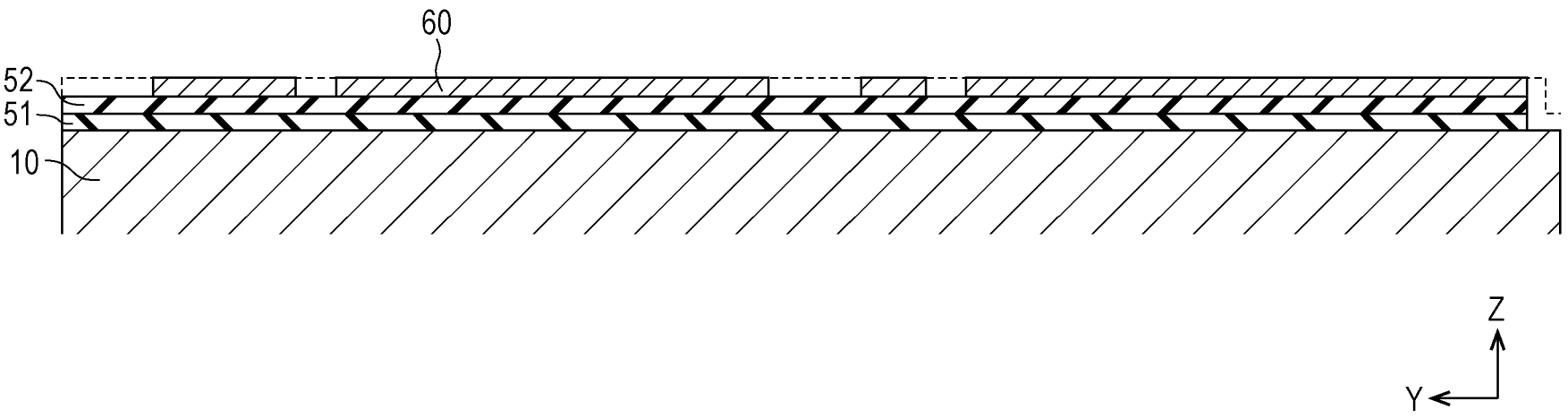
FIG. 4 is a sectional view illustrating a manufacturing method of the recording head according to Embodiment 1 of the invention.

As illustrated in FIG. 4, a silicon oxide film 51 and a zirconium oxide film 52 are stacked as the vibration plate 50 over one surface of the flow path forming substrate 10, the first electrode 60 is provided thereon, and patterning is performed.

A manufacturing method of the silicon oxide film 51, is a method of, for example, thermally oxidizing the flow path forming substrate 10 made of a silicon single crystal substrate to form the silicon oxide film 51. Of course, the silicon oxide film 51 may be formed by a sputtering method or the like.

Figure 5:
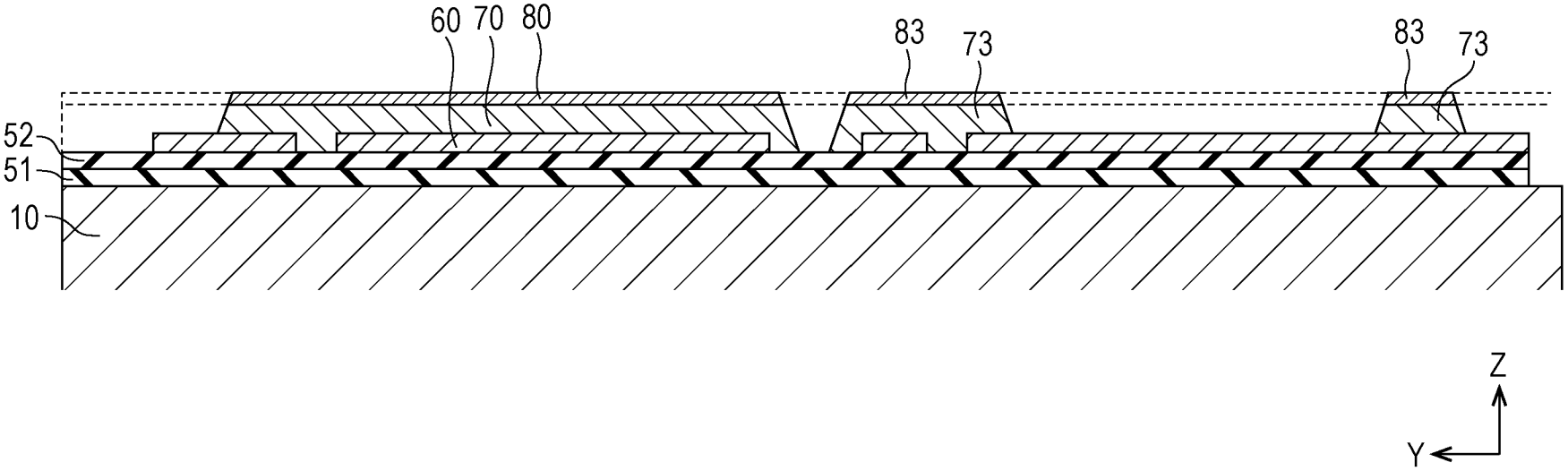
FIG. 5 is a sectional view illustrating a manufacturing method of the recording head according to Embodiment 1 of the invention.

Next, as illustrated in FIG. 5, the piezoelectric layer 70 and the second electrode 80 are formed and patterned. The piezoelectric layer 70 may be formed by a liquid phase method such as a sol-gel method or a Metal-Organic Decomposition (MOD) method, a Physical Vapor Deposition (PVD) method (vapor phase method) such as a sputtering method, a laser ablation method.

Figure 6:
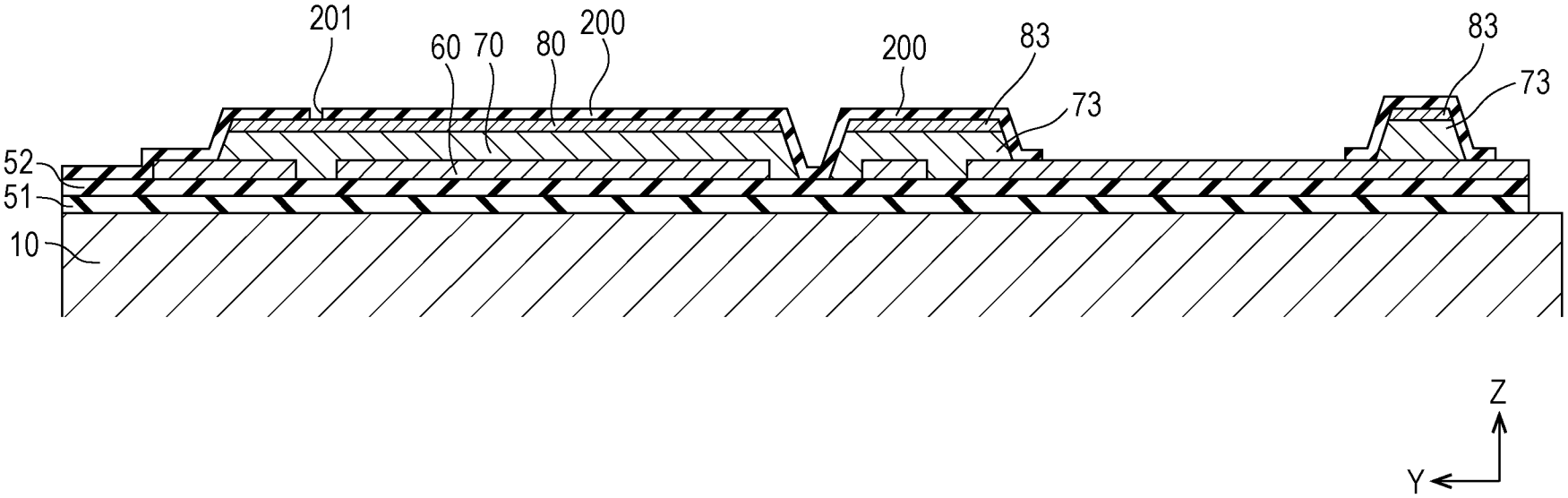
FIG. 6 is a sectional view illustrating a manufacturing method of the recording head according to Embodiment 1 of the invention.
Figure 7:
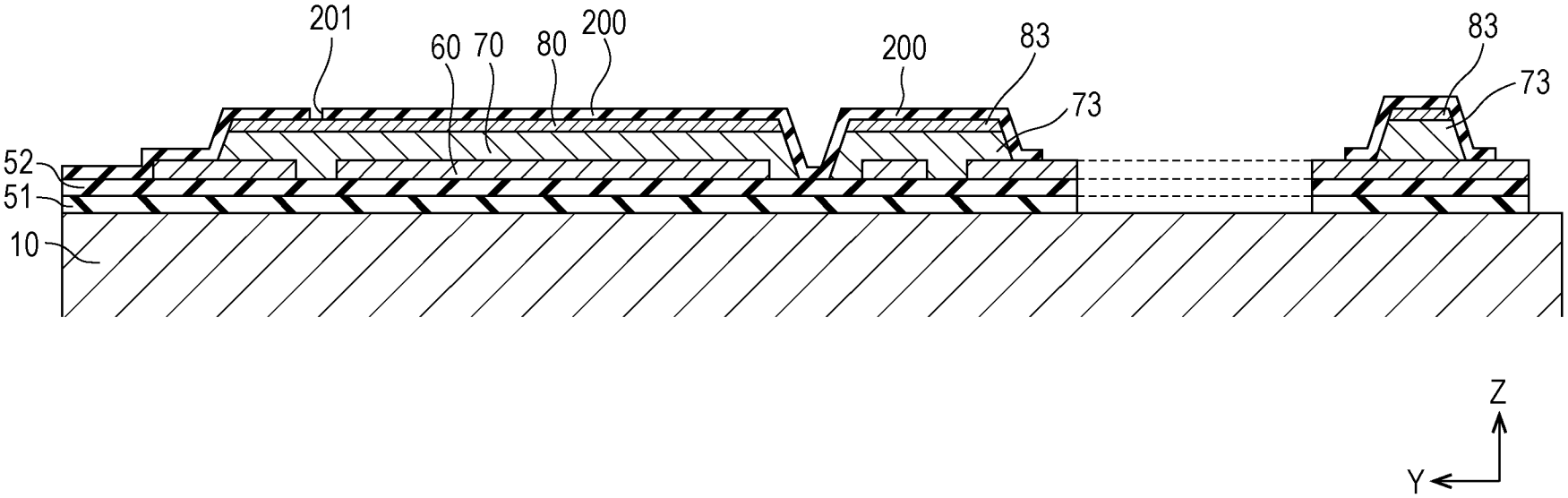
FIG. 7 is a sectional view illustrating a manufacturing method of the recording head according to Embodiment 1 of the invention.

As illustrated in FIG. 6, by forming the protective film 200, electrical insulation between the first electrode 60 and the second electrode 80 is reliably achieved. Then, the protective film 200 is patterned to remove the first connection hole 201 and the protective film 200 of the portion to be the above-described sealing portion. Further, as illustrated in FIG. 7, the first electrode 60, the zirconium oxide film 52, and the silicon oxide film 51 in a portion to be a sealing portion are removed.

Figure 8:
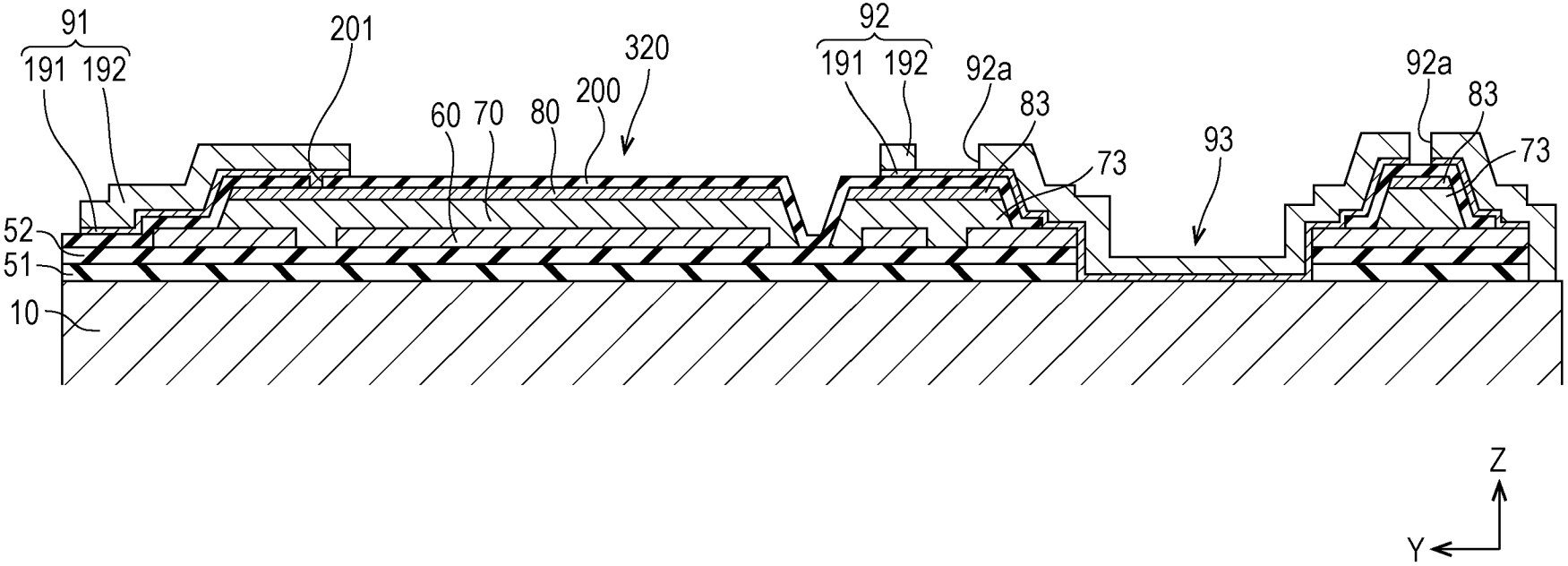
FIG. 8 is a sectional view illustrating a manufacturing method of the recording head according to Embodiment 1 of the invention.

As illustrated in FIG. 8, the individual lead electrode 91, the dummy lead electrode 92, and the sealing portion 93 are formed by forming the underlayer 191 and the wiring layer 192 and patterning the underlayer 191 and the wiring layer 192.

Figure 9:
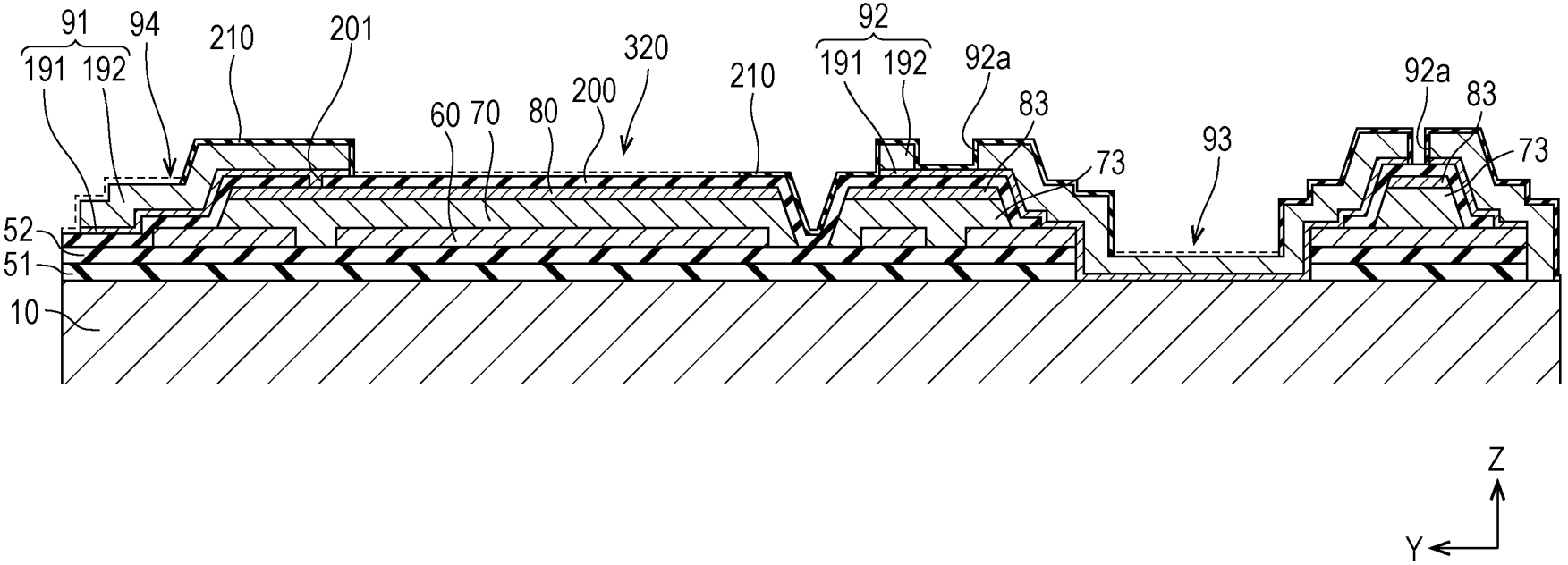
FIG. 9 is a sectional view illustrating a manufacturing method of the recording head according to Embodiment 1 of the invention.

Next, as illustrated in FIG. 9, after forming the insulating protective film 210 as a whole, the insulating protective film 210 is removed from the connection portion 94 where the individual lead electrode 91 is connected to an external wiring, the region of the active portion 320, and the region of the sealing portion 93.

Thereafter, the communication portion 13, the pressure generation chamber 12, and the like are removed by wet etching or the like, the protective substrate 30 is bonded, the underlayer 191 and the wiring layer 192 of the sealing portion 93 are removed, and the communication portion 13 communicates with the manifold portion 31 to form the recording head 1 (see FIG. 3). Since these steps are same as a usual method, explanation thereof will be omitted.

In the embodiment 1 described above, the insulating protective film 210 is provided at a position other than the active portion 320 and the connection portion where the individual lead electrode 91 is connected to the external wiring, and the patterning end portion of the underlayer 191 is completely covered with the insulating protective film 210 thereby significantly improving moisture resistance and ink resistance.

Embodiment 2

Figure 10:
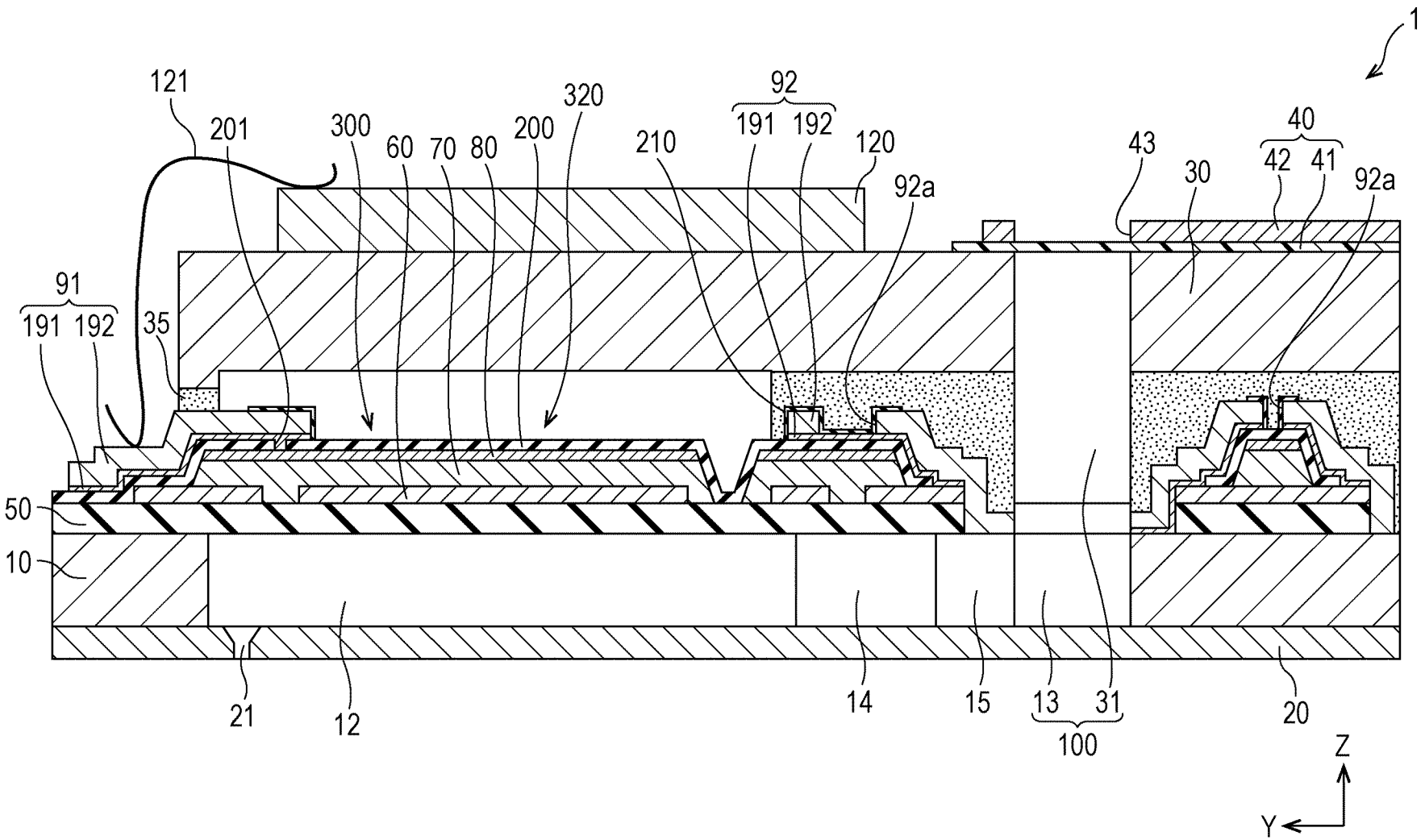
FIG. 10 is a sectional view illustrating a recording head according to Embodiment 2 of the invention.

FIG. 10 is a sectional view of an ink jet type recording head as an example of a liquid ejecting head according to Embodiment 2 of the invention. The same reference numerals are given to the same members as those in the embodiment described above, and redundant description is omitted.

As illustrated in FIG. 10, in the embodiment, the insulating protective film 210 is provided on the minimum area to cover the region where the longitudinal end portion of the individual lead electrode 91 and the patterning end portion of the underlayer 191 at the end portion in the width direction are exposed, and the recessed portion 92*a* of the dummy lead electrode 92 in which the underlayer 191 is exposed and the patterning end portion.

In this way, it is possible to improve the durability, particularly by protecting the region where it is desired to secure moisture resistance and ink resistance with the insulating protective film 210.

Embodiment 3

Figure 11:
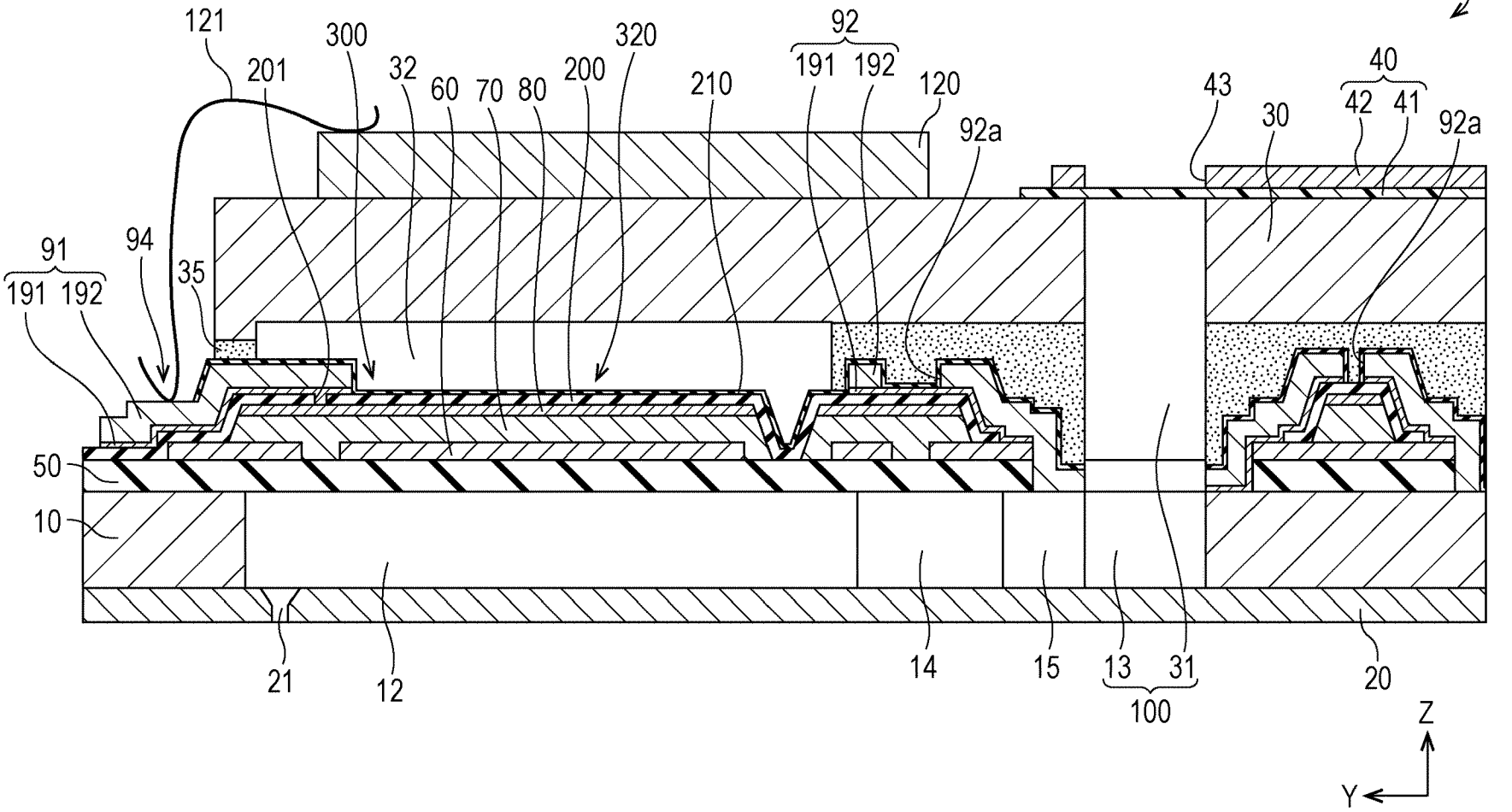
FIG. 11 is a sectional view illustrating a recording head according to Embodiment 3 of the invention.

FIG. 11 is a sectional view of an ink jet type recording head as an example of a liquid ejecting head according to Embodiment 3 of the invention. The same reference numerals are given to the same members as those in the embodiment described above, and redundant description is omitted.

As illustrated in FIG. 11, in the embodiment, the insulating protective film 210 is provided on almost the entire surface including the active portion 320, except for the connection portion 94 where the individual lead electrode 91 is connected to the external wiring.

As a result, the portion where the underlayer 191 is exposed can be protected by the insulating protective film 210, and significant improvement of moisture resistance and ink resistance can be surely achieved.

Embodiment 4

In the embodiment described above, the first electrode 60 is used as a common electrode, and the exposed portion of the piezoelectric layer 70 is covered with the protective film 200 to improve the moisture resistance of the piezoelectric layer 70. However, the second electrode 80 can also be used as a common electrode. In a case where the second electrode is a common electrode, the second electrode 80 can be provided as a moisture-resistant protective film to cover the piezoelectric layer 70. However, even in such a liquid ejecting head, by similarly providing the insulating protective film 210, the same effect can be obtained. In other words, in this case, there is no protective film 200 which is the second insulating protective film for protecting the piezoelectric layer 70, but, there may be a case where providing an interlayer insulating layer is required in order to prevent electrical conduction between the lead electrode led out from the first electrode 60, which is an individual electrode, and the second electrode 80.

Figure 12:
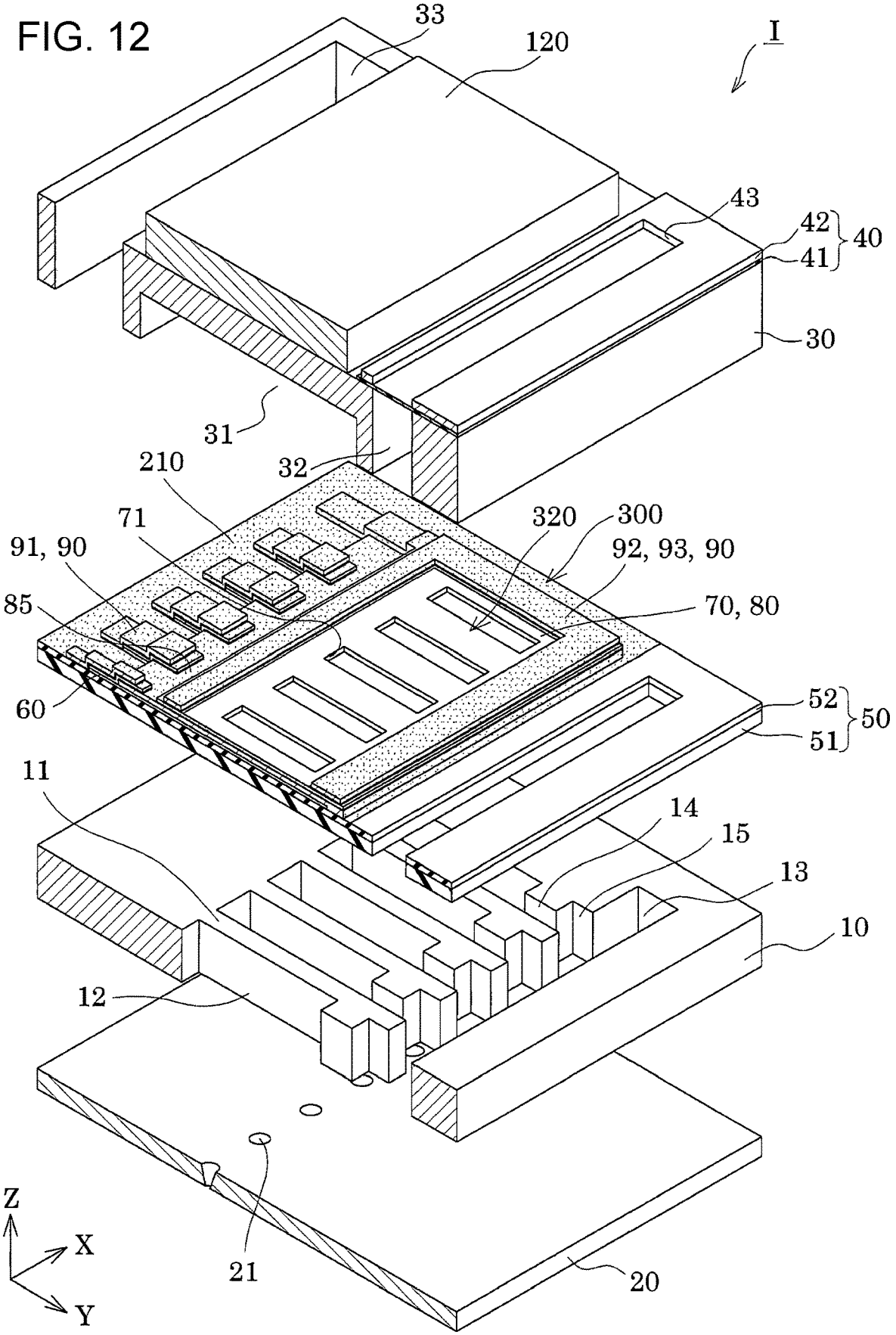
FIG. 12 is an exploded perspective view illustrating a recording head according to Embodiment 4 of the invention.
Figure 13:
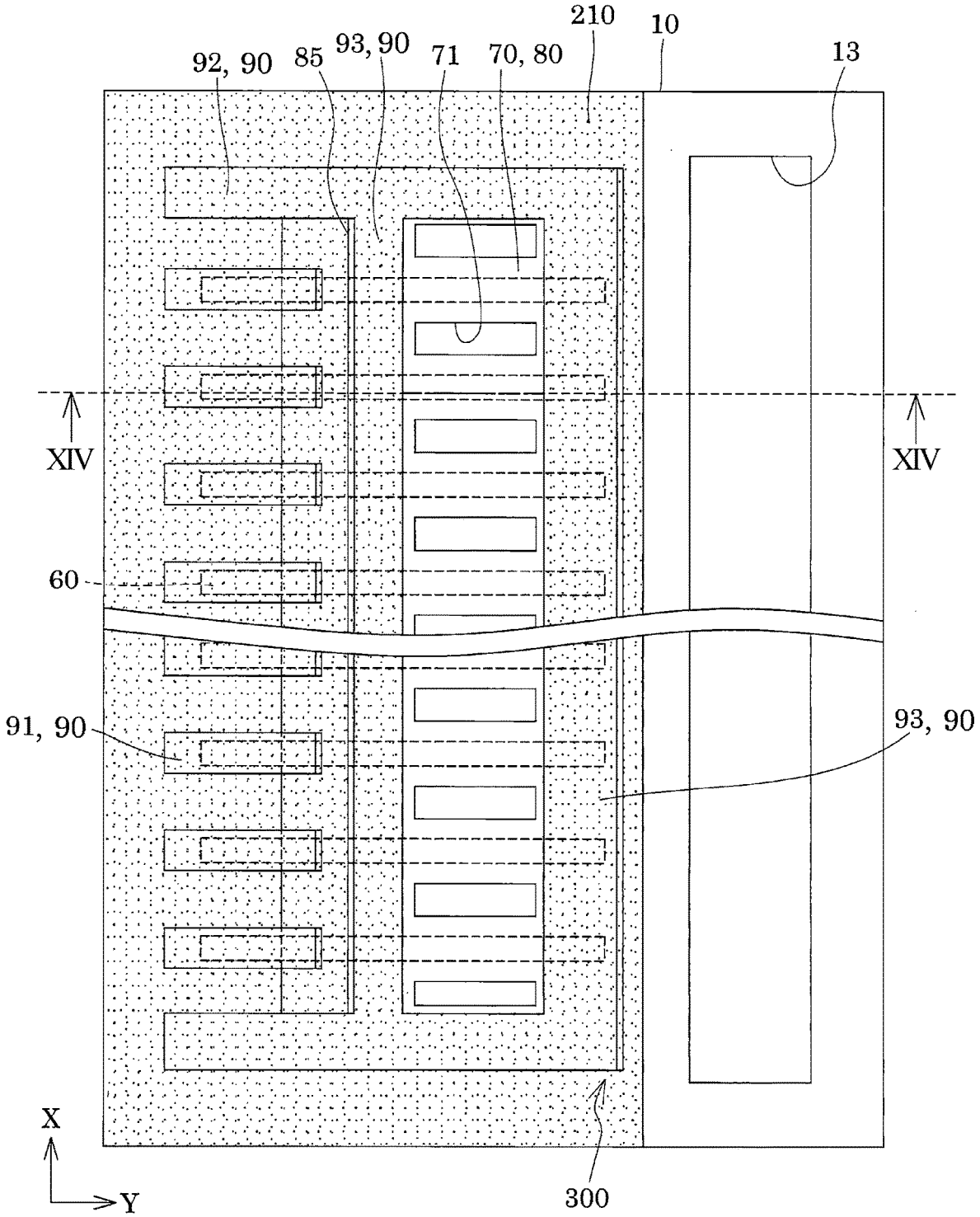
FIG. 13 is a plan view illustrating the recording head according to Embodiment 4 of the invention.
Figure 14:
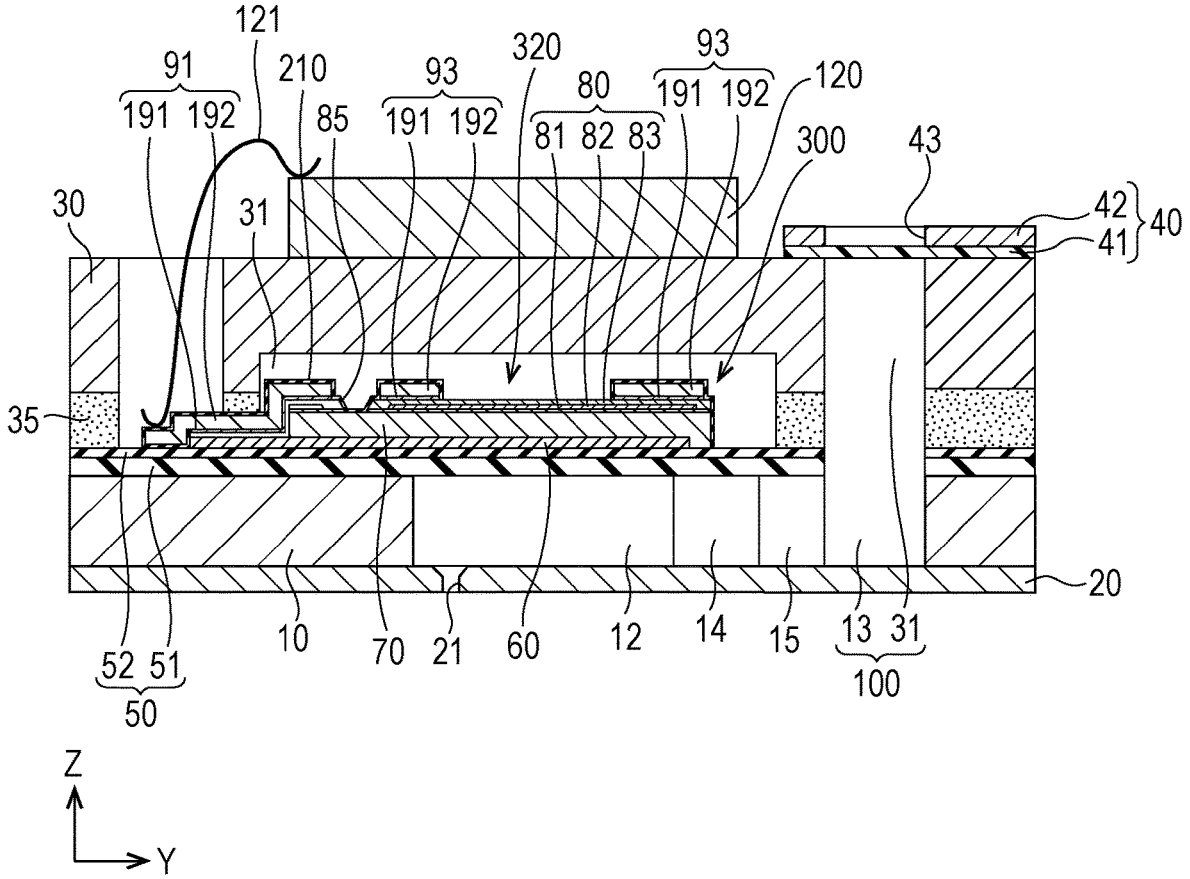
FIG. 14 is a sectional view illustrating the recording head according to Embodiment 4 of the invention.

FIGS. 12 to 14 are respectively an exploded perspective view, a plan view, and a sectional view of a main part taken along the line XIV-XIV of an example of an ink jet type recording head which is an example of such a liquid ejecting head. The same reference numerals are given to the same members as those in the embodiment described above, and redundant description is omitted.

As illustrated in the drawings, in the embodiment, the second electrode 80 which is a common electrode covers the piezoelectric layer 70. One end portion of the second electrode 80 is electrically cut by a removal portion 85, and the second electrode 80 outside the removal portion 85 is patterned for each piezoelectric layer 70 and is connected to the first electrode 60 to be the individual electrode on the outside of the end portion. The individual lead electrode 91 including the underlayer 191 and the wiring layer 192 is provided on the second electrode 80, and the dummy lead electrodes 92 are provided at both ends of the active portion 320 of the piezoelectric layer 70. The insulating protective film 210 is respectively provided to cover the exposed portion of the underlayer 191 of the individual lead electrode 91 and the dummy lead electrode 92. The insulating protective film 210 is as described in Embodiment 1 and repeated explanation is omitted, but by providing the insulating protective film 210, it is possible to improve the moisture resistance and ink resistance of the underlayer 191. In the embodiment, the insulating protective film 210 is provided to cover the removal portion 85, thereby improving the moisture resistance of the piezoelectric layer 70 exposed at the removal portion 85. Although the insulating protective film 210 is provided to cover the dummy lead electrode 92, since the insulating protective film 210 does not function as potential wiring, the insulating protective film 210 may be omitted.

As a result, the entire portion where the underlayer 191 is exposed can be protected with the insulating protective film 210, and significant improvement of moisture resistance and ink resistance can be surely achieved.

Another Embodiment

Figure 15:
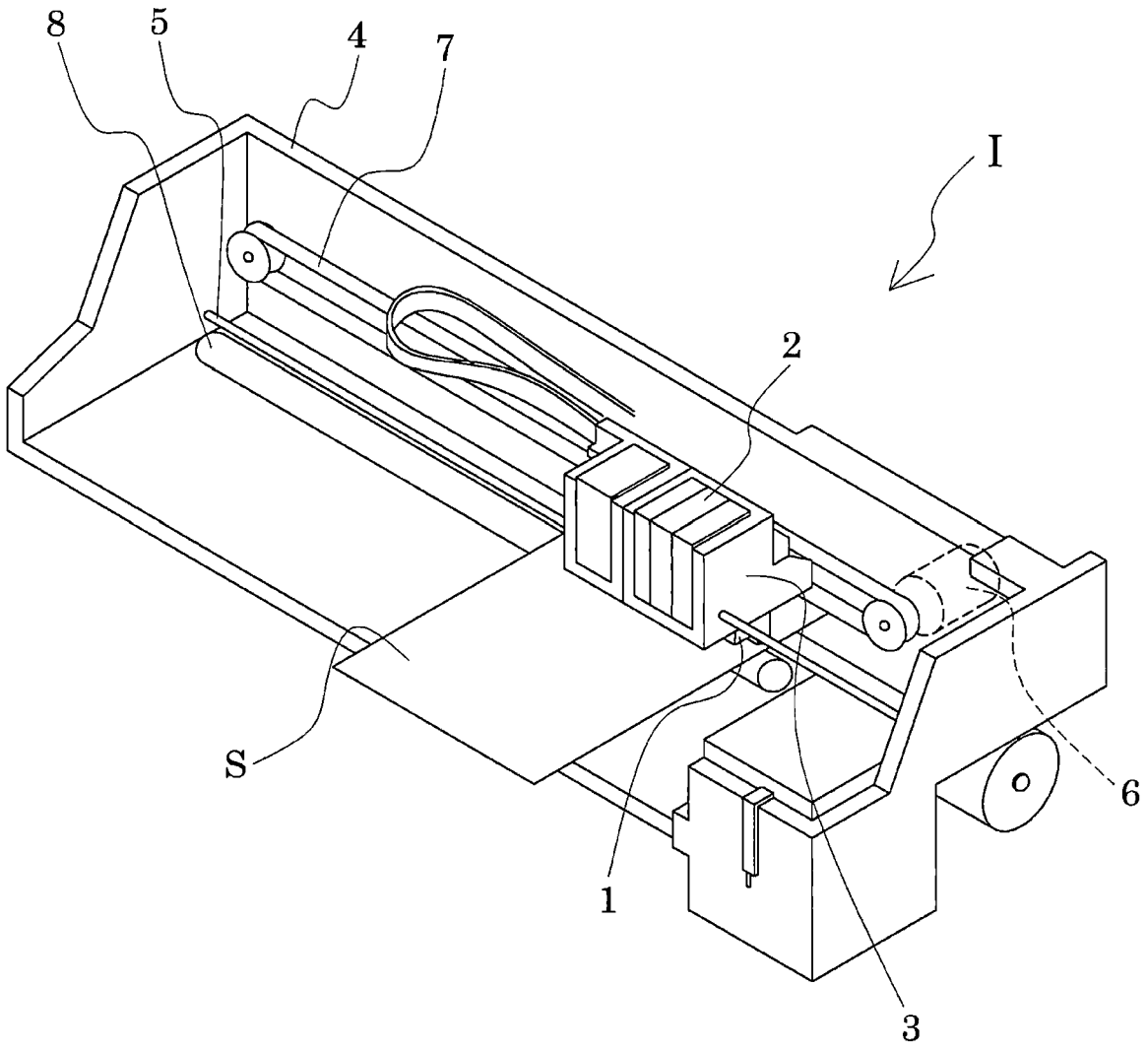
FIG. 15 is a diagram illustrating a schematic configuration of a recording apparatus according to an embodiment of the invention.

The recording head 1 of each of these embodiments is mounted on an ink jet type recording apparatus. FIG. 15 is a schematic diagram illustrating an example of the ink jet type recording apparatus.

In an ink jet type recording apparatus I illustrated in FIG. 15, with an ink cartridge 2 constituting storage means is detachably provided on the recording head 1, and a carriage 3 on which the recording head 1 is mounted is provided to be movable in the axial direction on a carriage shaft 5 attached to an apparatus main body 4.

Then, the driving force of a driving motor 6 is transmitted to the carriage 3 through a plurality of gears (not illustrated) and the timing belt 7, whereby the carriage 3 on which the recording head 1 is mounted is moved along the carriage shaft 5. On the other hand, the apparatus main body 4 is provided with a transport roller 8 as transport means, and a recording sheet S as a recording medium such as paper is transported by the transport roller 8. The transport means for transporting the recording sheet S is not limited to the transport roller, but may be a belt, a drum or the like.

In the ink jet type recording apparatus I described above, the recording head 1 is mounted on the carriage 3 and moves in the main scanning direction, but, the invention is not limited thereto, and for example, the invention can also be applied to a so-called line type recording apparatus in which the recording head 1 is fixed and which performs printing by merely moving the recording sheet S such as paper in the sub-scanning direction.

In addition, in the example described above, the ink jet type recording apparatus I has a configuration in which the ink cartridge 2 as liquid storage means is mounted on the carriage 3, but the invention is not particularly limited thereto, and for example, liquid storage means such as an ink tank may be fixed to the apparatus main body 4 and the storage means and the recording head 1 may be connected through a supply pipe such as a tube. In addition, the liquid storage means may not be mounted on the ink jet type recording apparatus.

In the embodiment 1 described above, an ink jet type recording head has been described as an example of a liquid ejecting head, but the invention is broadly applied to a general liquid ejecting head, and, the invention can also be applied to a liquid ejecting head for ejecting liquid other than ink. Examples of other liquid ejecting heads include various recording heads used in image recording apparatuses such as printers, color material ejecting heads used for manufacturing color filters such as liquid crystal displays, organic EL displays, an electrode material ejecting head used for forming an electrode such as field emission displays (FEDs), a bioorganic material ejecting head used for manufacturing a biochip, and the like.

In addition, the invention is not limited to a piezoelectric device used for a liquid ejecting head, and can be applied to other piezoelectric devices having a substrate on which a recessed portion is formed and a piezoelectric actuator which is provided on one surface of the substrate with a vibration plate interposed therebetween can be used. Other piezoelectric devices include, for example, an ultrasonic device such as an ultrasonic transmitter, an ultrasonic motor, a temperature-electric converter, a pressure-electric converter, a ferroelectric transistor, a piezoelectric transformer, a blocking filter for harmful light such as infrared ray, an optical filter using photonic crystal effect by quantum dot formation, a filter such as an optical filter utilizing optical interference of the thin film, an infrared sensor, various sensors such as an ultrasonic sensor, a thermal sensor, a pressure sensor, a pyroelectric sensor, and a gyroscopic sensor (angular velocity sensor), ferroelectric memories, and the like.

The present application is based on, and claims priority from JP Application Serial Number 2018-52134, filed Mar. 20, 2018, the disclosure of which is hereby incorporated by reference herein in its entirety.

What is claimed is:

1. A liquid ejecting head comprising:

a piezoelectric element which includes a piezoelectric layer, and a first electrode and a second electrode sandwiching the piezoelectric layer therebetween;

a leading-out wiring provided on an upper portion of the piezoelectric element and including a wiring layer made of a material selected from gold and platinum and an underlayer which are patterned; and an insulating protective layer which covers at least an exposed portion on the underlayer of the leading-out wiring.

2. The liquid ejecting head according to claim 1, wherein the underlayer is made of a material selected from chromium, nickel, a nickel chromium alloy, aluminum, and copper.

3. A liquid ejecting apparatus comprising the liquid ejecting head according to claim 2.

4. The liquid ejecting head according to claim 1, wherein a recessed portion exposing the underlayer of the wiring layer is provided, and the insulating protective layer is also provided in the recessed portion.

5. A liquid ejecting apparatus comprising the liquid ejecting head according to claim 4.

6. The liquid ejecting head according to claim 1, further comprising:

a second insulating protective layer on a lower side of the underlayer.

7. The liquid ejecting head according to claim 6, wherein the insulating protective layer and the second insulating protective layer are made of the same material.

8. A liquid ejecting apparatus comprising the liquid ejecting head according to claim 7.

9. The liquid ejecting head according to claim 6, wherein the insulating protective layer is thicker than the second insulating protective layer.

10. A liquid ejecting apparatus comprising the liquid ejecting head according to claim 9.

11. A liquid ejecting apparatus comprising the liquid ejecting head according to claim 6.

12. The liquid ejecting head according to claim 1, wherein the piezoelectric element is provided on a flow path substrate provided with a pressure chamber communicating with a nozzle opening that discharges a liquid, the flow path substrate is bonded with a protective substrate having a piezoelectric element holding portion that is a space for holding the piezoelectric element, a dummy wiring is provided in a region where the leading-out wiring is not provided in a bonding area of the flow path substrate with which the protective substrate is bonded, and the insulating protective layer is provided on the dummy wiring.

13. The liquid ejecting head according to claim 12, wherein the insulating protective layer is not provided in a region facing the pressure chamber.

14. A liquid ejecting apparatus comprising the liquid ejecting head according to claim 13.

15. The liquid ejecting head according to claim 12, wherein the liquid is a solvent ink or a water-based ink.

16. A liquid ejecting apparatus comprising the liquid ejecting head according to claim 15.

17. A liquid ejecting apparatus comprising the liquid ejecting head according to claim 12.

18. A liquid ejecting apparatus comprising the liquid ejecting head according to claim 1.

* * * * *